US011904209B1

(12) United States Patent
Vogler

(10) Patent No.: US 11,904,209 B1
(45) Date of Patent: Feb. 20, 2024

(54) CLIMBING CAMS AND ATTACHMENT SYSTEMS

(71) Applicant: Utah State University, Logan, UT (US)

(72) Inventor: Baylee Anne Vogler, Logan, UT (US)

(73) Assignee: Utah State University, Logan, UT (US)

( * ) Notice: Subject to any disclaimer, the term of this patent is extended or adjusted under 35 U.S.C. 154(b) by 0 days.

(21) Appl. No.: 18/132,612

(22) Filed: Apr. 10, 2023

Related U.S. Application Data

(60) Provisional application No. 63/404,425, filed on Sep. 7, 2022.

(51) Int. Cl.
*A63B 29/02* (2006.01)

(52) U.S. Cl.
CPC ..... *A63B 29/024* (2013.01)

(58) Field of Classification Search
CPC ..... A63B 29/024
USPC ..... 248/925, 305, 306; 74/567; 81/486
See application file for complete search history.

(56) References Cited

U.S. PATENT DOCUMENTS 5,582,377 A * 12/1996 Quesada ..... A47G 25/08 248/316.4
5,820,181 A 12/1998 Le Noach
6,802,848 B2 * 10/2004 Anderson ..... A61B 17/1227 606/151
7,578,827 B2 * 8/2009 Gadberry ..... A61B 17/0487 606/151
10,792,520 B2 10/2020 Borass et al.
11,235,202 B2 2/2022 Connell

FOREIGN PATENT DOCUMENTS

| | | | | |
|---|---|---|---|---|
| EP | 2353664 | | 8/2011 | |
| EP | 2641635 | | 9/2013 | |
| GB | 2419632 | A * | 5/2006 | ..... A63B 29/024 |
| IT | 2020000000409 | | 7/2021 | |
| KR | 20100010088 | | 10/2010 | |
| WO | WO-2014152150 | A1 * | 9/2014 | ..... A63B 29/024 |
| WO | 2021090225 | | 5/2021 | |

* cited by examiner

*Primary Examiner* — Kimberly T Wood

(74) *Attorney, Agent, or Firm* — Thorpe North & Western, LLP.

(57) ABSTRACT

A climbing cam can include a stem forming the main body of the climbing cam. A moveable latch can be disposed on the stem and operable to tether the steam to a climbing harness of a climber. A spring-loaded cam lobe can be disposed on a first end of the stem. A trigger can be connected to the cam lobe so that the trigger is actuatable to retract the cam lobe from an expanded position to a retracted position and to open the moveable latch, allowing the stem to untether from the climbing harness when the cam lobe is in the retracted position.

19 Claims, 5 Drawing Sheets

CLIMBING CAMS AND ATTACHMENT SYSTEMS

RELATED APPLICATION

This application claims priority to U.S. Provisional Application No. 63/404,425, filed Sep. 7, 2022, which is incorporated herein by reference.

BACKGROUND

In outdoor recreation, traditional ("trad") climbing is a type of rock climbing that involves placing removable gear in cracks as the climber scales a rock wall. A spring-loaded camming device (a.k.a. SLCD, camming device, cam) is a piece of protective equipment that expands and contracts to fit within the cracks of a rock wall. The cam also expands when significant tension is applied to the stem portion of the device. This tension usually occurs when a climber falls, and, when properly placed in solid rock, holds the climber in place with the force of friction.

SUMMARY

In one example of a climbing cam according to the present disclosure, a climbing cam can comprise a stem forming the main body of the climbing cam. The stem can comprise a first end and a second end opposite the first end. The climbing cam can further comprise a moveable latch that can be disposed on the stem. The moveable latch in this example can be operable to tether the stem to a climbing harness of a climber while allowing detachment from the climbing harness and loading of the climbing cam in one fluid movement, as will be explained in more detail below.

The climbing cam can further comprise spring-loaded cam lobes. The spring-loaded cam lobes can be disposed on the first end of the stem. The spring-loaded cam lobes can be operable to lock the climbing cam into a crack of a rock during use. The climbing cam can further comprise a trigger that can be connected to the cam lobe. The trigger can be actuatable to retract the cam lobe from an expanded position (e.g. a position in which the cam lobes are during use and in which the cam lobes can frictionally lock into a crack of a rock) to a retracted position (e.g. a position that allows a user to insert and remove the climbing cam into and out of the crack of a rock). Simultaneously, the trigger can also be operable to open the moveable latch to allow the stem to untether from the climbing harness when the cam lobe is in the retracted position. In one example, the lobe can have a logarithmic spiral shape to provide equal loading against the rock as a downward force is applied.

In another example, a climbing cam can include a stem comprising a first end and a second, where the first end comprises a clip point. An attachment aperture can be disposed on the stem between the first end and the second end of the stem. The attachment aperture can include a fixed hook that is formed stationary relative to the stem and a moveable latch that is moveable relative to the stem. The moveable latch can be operable to move adjacent to and in contact with the fixed hook to close the attachment aperture and to move away from the fixed hook to open the attachment aperture. The moveable hook can be biased into contact with the fixed hook. This example can also include a sling including a first connection point that attaches to the clip point at the first end of the stem. The sling can also include a second connection point that attaches to the attachment aperture. The sling can be operable to tether the stem to a climbing harness of a climber. A plurality of spring-loaded lobes can be disposed on an end of the stem. The plurality of cam lobes can be moveable from an expanded position to a retracted position, and the plurality of cam lobes can be biased toward the expanded position. This example can also include a trigger connected to the cam lobes by at least one trigger cable. The trigger can be actuatable to retract the cam lobes from the expanded position to the retracted position via the trigger cable. The trigger can also be operable to actuate the moveable latch to move away from the fixed hook to open the attachment aperture. Thus, the trigger can be operable to allow the stem to untether from the climbing harness while the cam lobes are in the retracted position.

Another example can include an attachment system for a climbing cam. The attachment system can be an integral part of the climbing cam or added onto a climbing cam, such as an aftermarket upgrade. The example attachment system can include a hook fixable to a stem of the climbing cam such that the hook is stationary relative to the stem. This example can also include a sleeve sized and shaped to surround the stem and slide relative to the stem. The sleeve can comprise a latch positioned to contact the hook when the latch is in a closed position. A spring can be positioned to bias the sleeve such that the latch is biased against the hook to form an aperture. When the latch is in the closed position, the sleeve can be positioned to engage with a trigger of the climbing cam when the trigger is pulled by a user to move the latch away from the hook to open the aperture.

Figure 1:
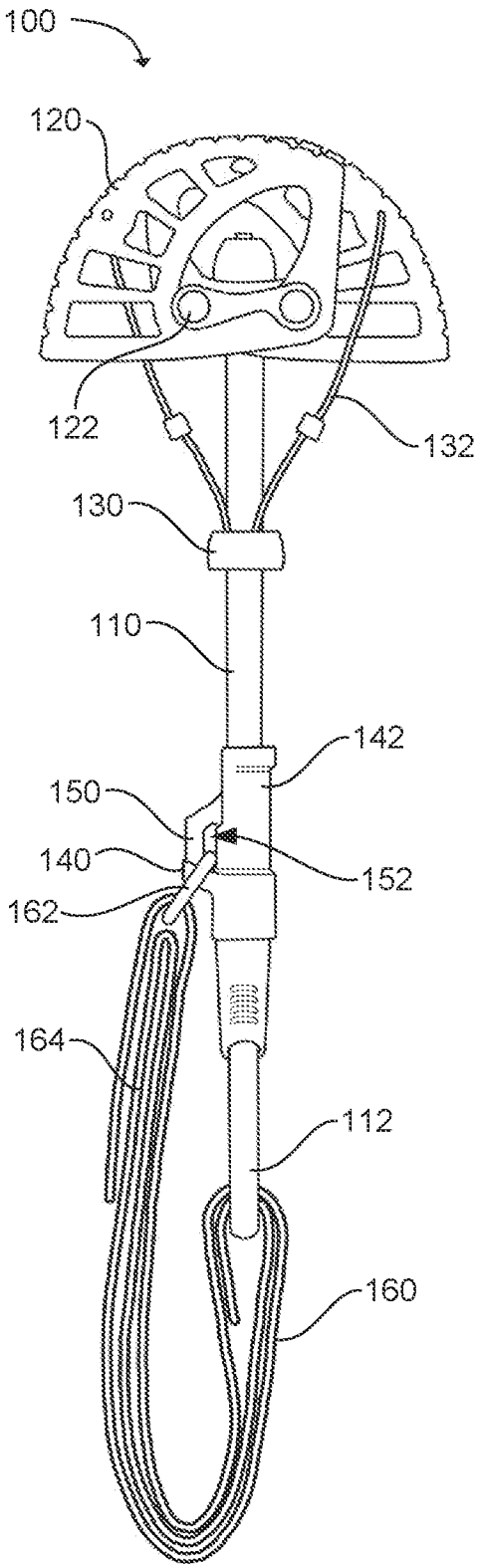
FIG. 1 shows a side view of an example climbing cam in accordance with the present disclosure.

These drawings are provided to illustrate various aspects of the subject technology and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the subject technology, it should be understood that other embodiments may be realized and that various changes may be made without departing from the spirit and scope of the present invention. Thus, the following more detailed description of the embodiments is not intended to be limiting, but is presented for purposes of illustration only and not limitation to describe the features and characteristics of the subject technology, to set forth the best mode of operation, and to sufficiently enable one skilled in the art to practice the subject technology. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "a spring" includes reference to one or more of such mechanisms and reference to "retracting" refers to one or more such steps.

Various terms may be used herein to describe orientation, direction, and location devices and components. For example, these terms may include "top," "bottom," "front, ""back," "left," "right," "above," "below," and so on. These terms are used for convenience to describe relative positions of features of the devices and systems described herein. It should be understood that devices described herein can be used in a variety of orientations, and therefore these terms should not be considered as limiting the overall orientation of the devices. For example, the "top" of a device may be oriented downward in some cases, the "front" of a device may face in a different direction in some cases, and so on.

As used herein, the term "about" is used to provide flexibility and imprecision associated with a given term, metric or value. The degree of flexibility for a particular variable can be readily determined by one skilled in the art. However, unless otherwise enunciated, the term "about" generally connotes flexibility of less than 2%, and most often less than 1%, and in some cases less than 0.01%.

As used herein with respect to an identified property or circumstance, "substantially"refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As used herein, the term "at least one of" is intended to be synonymous with "one or more of." For example, "at least one of A, B and C" explicitly includes only A, only B, only C, and combinations of each.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5,"which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Climbing Cam

Traditional or "trad" climbing involves carrying and placing cams or other protection devices while climbing a rock face. Spring-loaded cams are a useful active protection device. These cams can include lobes that pull inward when a trigger is pulled, and then expand outward when the trigger is released. When placed correctly, these cams can hold firm in a crack even when exposed to a significant load.

Trad climbers often need to quickly place cams while climbing. However, this proves difficult with current methods. In order to use and place cams, a climber must first unclip the camming device from their harness (typically via a carabiner type clip that tethers the cam to the harness), then change their grip on the cam to "load" it by pulling a trigger (i.e. to retract the cam lobes of the cam so that the cam lobes can fit into a crack in the rock), and then place it into the crack in the rock. With current methods, the climber usually places the cam in their mouth to change their grip on the device. This can lead to accidently dropping the camming device, can potentially damage the climber's teeth, and can waste the time and energy of the climber.

The climbing cams and systems disclosed herein can reduce these problems by eliminating the need to change the grip by combining the loading and detachment processes into one fluid movement. In particular, the climbing cams described herein can be tethered to a climbing harness by a moveable latch. The trigger of the climbing cam can be operable to open the moveable latch when the trigger is pulled. The trigger can also retract the cam lobes to prepare the cam to be inserted into a crack. Thus, a climber can use a single motion of pulling the trigger to untether the cam from the climbing harness and prepare the cam for placement in the crack. The cams described herein can allow the climber to perform these tasks more easily without changing the grip on the cam.

In one example, a climbing cam can include a stem, referring to an elongated portion of the climbing cam device. One or more spring loaded cam lobes can be disposed at a first end of the stem. A trigger can be connected to the spring-loaded cam lobe such that actuating the trigger retracts the cam lobe from an expanded position to a retracted position. The climbing cam can also include a moveable latch disposed on the stem. The moveable latch can be operable to tether the stem to a climbing harness of a climber when the latch is closed. However, the trigger can also be operable to open the moveable latch when the trigger is actuated. Therefore, actuating the trigger can simultaneously open the moveable latch to untether the stem from the climbing harness and retract the cam lobe.

In further examples, the moveable latch can be attached to a sleeve that slides relative to the stem of the climbing cam. The trigger can also slide relative to the stem. When the trigger is pulled, the trigger can contact the sleeve and push the sleeve along the stem. This motion can open the moveable latch. The term "moveable" is used to describe the latch because the latch can move in relation to other parts of the climbing cam when the trigger is actuated. In certain examples, the climbing cam can also include a fixed hook that remains stationary relative to other parts of the climbing cam. The moveable latch can be biased against the fixed hook by a spring when the latch is in a closed position. The latch can be opened when the trigger moves the latch away from the fixed hook. This mechanism is described in more detail and illustrated in figures below. However, the climbing cams described herein can incorporate a variety of different latch mechanisms. In various examples, the moveable latch can be configured to open when the trigger is actuated. In some examples, the moveable latch can be connected to the trigger so that the moveable latch moves in tandem with the trigger. In other examples, the moveable latch is not connected or in contact with the trigger until the trigger is pulled. When the trigger is pulled, the trigger can contact the moveable latch and move the latch from a closed position to an open position.

FIG. 1 is a side view of one example climbing cam 100. The climbing cam includes a stem 110. In this example, the stem has an elongated cylindrical shape. A plurality of spring-loaded cam lobes 120 are disposed on a first end of the stem. These cam lobes extend out from the stem, with some lobes extending forward and some lobes extending backward. The cam lobes are mounted to lobe axles 122 and can rotate about the lobe axles. In this example, the lobe axles are offset from the stem. One lobe axle is offset in front of the stem and another lobe axle is offset behind the stem. A spring can bias the cam lobes toward an extended position (i.e., the position shown in FIG. 1). A trigger 130 is disposed on the stem below the cam lobes. Although not visible from the angle shown in FIG. 1, the trigger includes a through-hole that surrounds the stem, and the trigger can slide along the stem. The trigger is connected to the cam lobes by cables 132. When the trigger is pulled downward, the cables pull the cam lobes into a retracted position. Because the cam lobes are spring-loaded, when the trigger is released the springs can return the cam lobes to their extended position and the cables can pull the trigger back up to its original position.

The examples shown in FIG. 1 also includes a moveable latch 140 disposed on a sleeve 142 surrounding the stem 110. The sleeve is slidable relative to the stem. A fixed hook 150 is formed on the stem adjacent to the moveable latch. The sleeve can be biased by a spring (not shown in FIG. 1) so that the moveable latch is biased against the fixed hook, forming an aperture 152. In this example, the latch is used to hold a connection ring 162 on a first end of a sling 160. The connection ring is held in the aperture while the latch is in the closed position. The sling is also attached to the stem at the second end of the sling. In this example, the stem includes a clip point 112 and the second end of the sling is attached to the clip point. The clip point is formed as a loop at the end of the stem opposite from the cam lobes. The sling can tether the climbing cam to a climbing harness of a climber. In many cases, a climber can carry many of these climbing cams tethered to the climbing harness.

As used herein, "connected" can mean that two parts are affixed together or in physical contact, in some cases so that movement of one part causes movement of another part to which it is connected. For example, a spring connected to a cam lobe can be a separate piece from the cam lobe, but the spring can be positioned in contact with the cam lobe so that force is transferred from the spring to the cam lobe. In other examples, the spring may not be in direct contact with the cam lobe, but force from the spring may be transferred to the cam lobe through another intermediate component. In this situation, the spring can still be described as being connected to the cam lobe because force from the spring is transferred to the cam lobe. In other examples, "connected" can include components that are affixed together using a connector, an adhesive, welding, or other method of connection.

Figure 2:
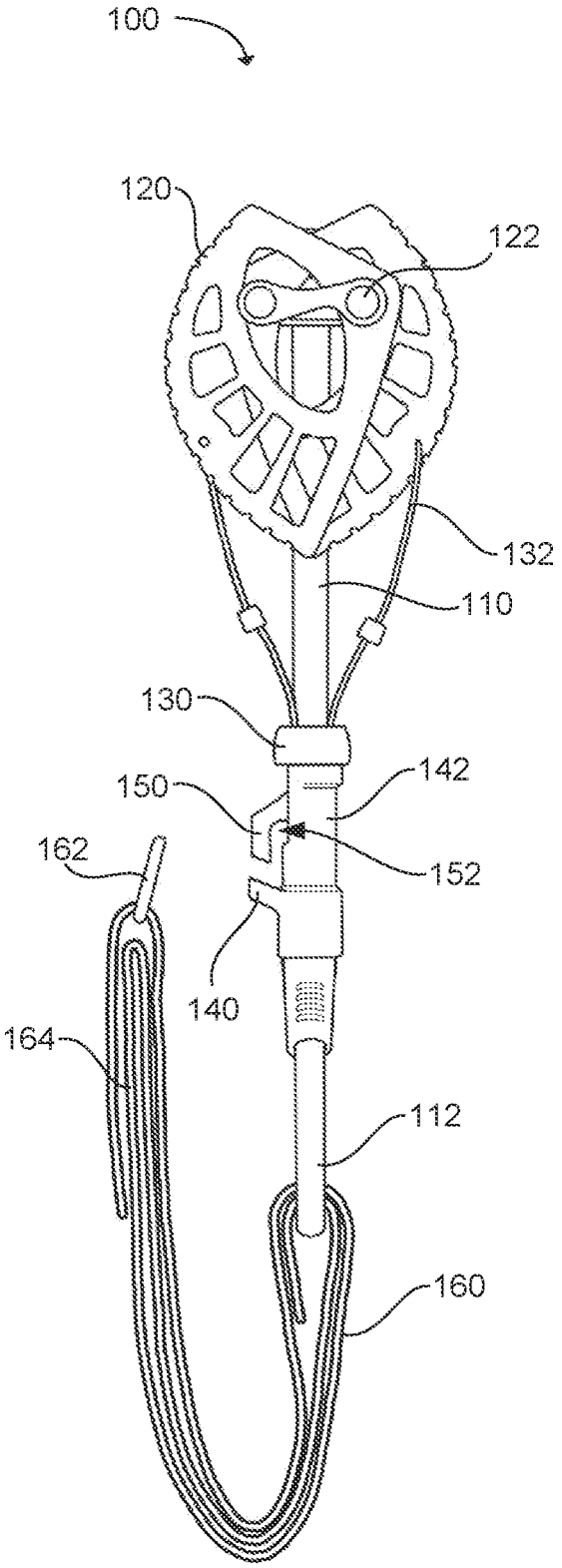
FIG. 2 shows a side view of another example climbing cam in accordance with the present disclosure.

FIG. 2 shows another example climbing cam 100 after the trigger 130 has been actuated. The trigger is actuated by pulling the trigger downward. This pulls the cables 132 and the cables cause the spring-loaded cam lobes 120 to rotate into the retracted position shown. In this position, the climbing cam is narrower and can be placed in a crack of a rock. When the cam lobes extend outward again, the cam lobes can contact the sides of the crack to wedge the cam in place.

FIG. 2 also shows how the trigger 130 comes in contact with the sleeve 142 and pushes the sleeve downward. The moveable latch 140 on the sleeve moves downward, away from the fixed hook 150. This opens the latch and allows the connection ring 162 to disconnect from the latch. If the sling 160 is wrapped around part of the climbing harness, then the sling can be removed from the climbing harness once the connection ring at the end of the sling has been freed. The sling also has an interior loop 164 that can be used to attach a climbing rope or harness to the sling after the cam has been placed. In some examples, the climbing rope or harness can be attached to the sling using a connector such as a carabiner. The sleeve can also include a spring to bias the moveable latch against the fixed hook. Therefore, when the trigger is released, the sleeve can slide back upward to close the latch because of the force of the spring. The spring is not visible in FIG. 2, but in this example the spring can be located inside a lower portion of the sleeve and the spring can surround the stem 110.

Figure 3:
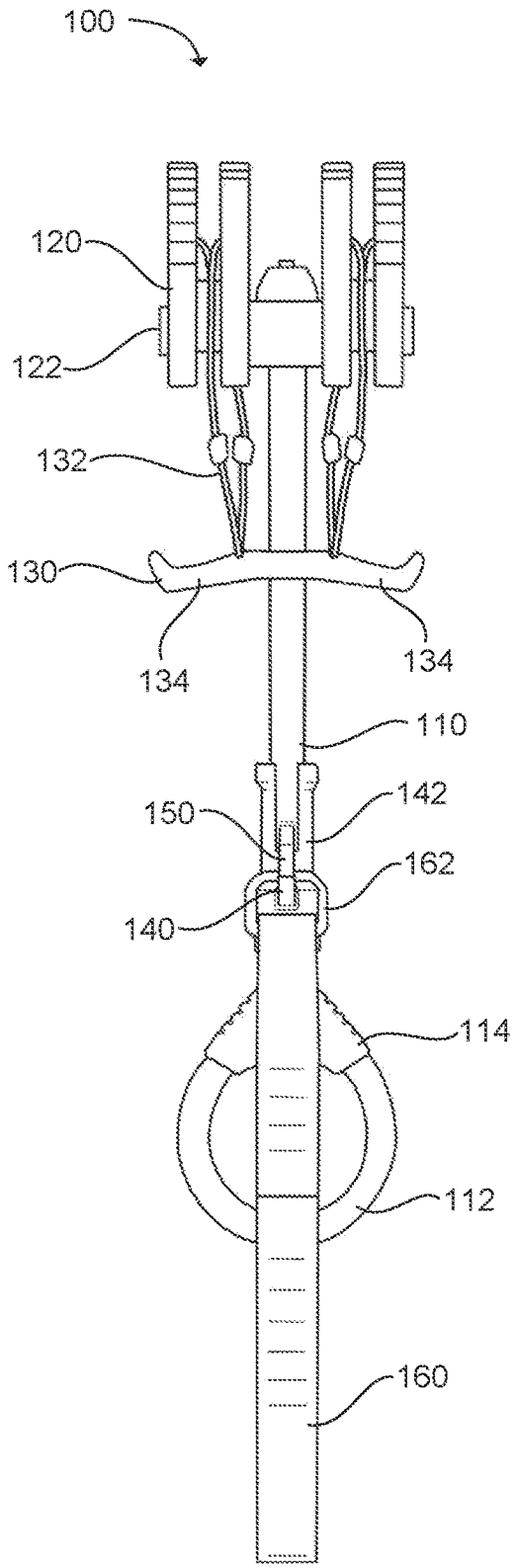
FIG. 3 shows a front view of another example climbing cam in accordance with the present disclosure.
Figure 4:
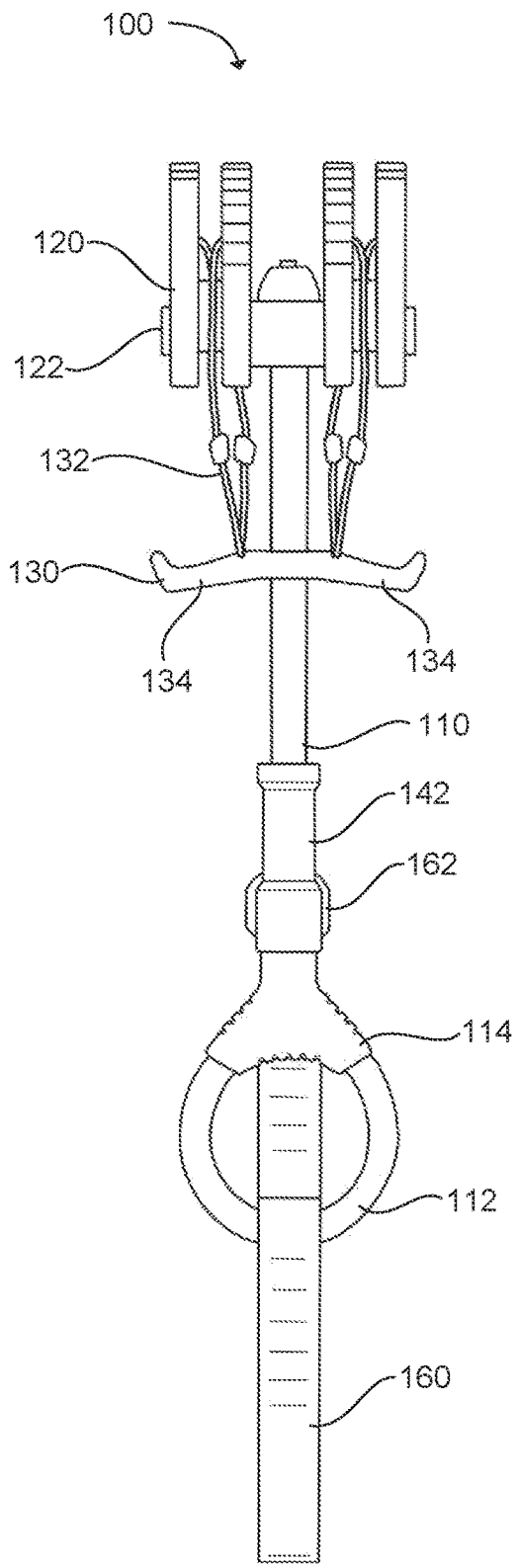
FIG. 4 shows a back view of another example climbing cam in accordance with the present disclosure.

FIG. 3 shows a front view of an example climbing cam 100. As used herein, the front of the climbing cam can refer to the face on which the moveable latch 140 is located. FIG. 4 shows a back view of the same example climbing cam. In these views, it can be seen that the climbing cam has four cam lobes 120. Two of the cam lobes extend toward the front and two extend toward the back. The cam lobes are connected to the trigger 130 by cables 132. The trigger includes two handles 134. These handles can be shaped and sized so that one or more fingers of a climber can be used to pull the trigger downward. The trigger can be pulled down the stem 110 until the trigger contacts the sleeve 142 that includes the moveable latch. The trigger can then push the sleeve downward to open the latch. The fixed hook 150 can be seen in the front view, formed as an integral part of the surface of the stem. The sleeve includes a hook slot 144 that allows the hook to extend outward past the sleeve, while also allowing the sleeve to slide up and down on the stem. This view also shows the connection ring 162 held in the aperture formed by the moveable latch and the fixed hook. One end of the sling 160 is attached to the connection ring. The other end of the sling is attached to the clip point 112, which is a loop formed at the bottom end of the stem. In this example, the loop includes a grip cover 114 that can be sized and shaped for a thumb of a climber to grip at the bottom end of the stem. In particular, the climber can grip the loop at the bottom end of the stem with the thumb and the two handles of the trigger with two or more fingers. The climber can then squeeze the thumb and fingers to pull the trigger down. FIG. 4 is a back view of the same example climbing cam. Many of the same features are visible from the back of the climbing cam, although the moveable latch and the fixed hook are not visible from this angle. Instead, the back face of the sleeve can be seen.

Figure 5:
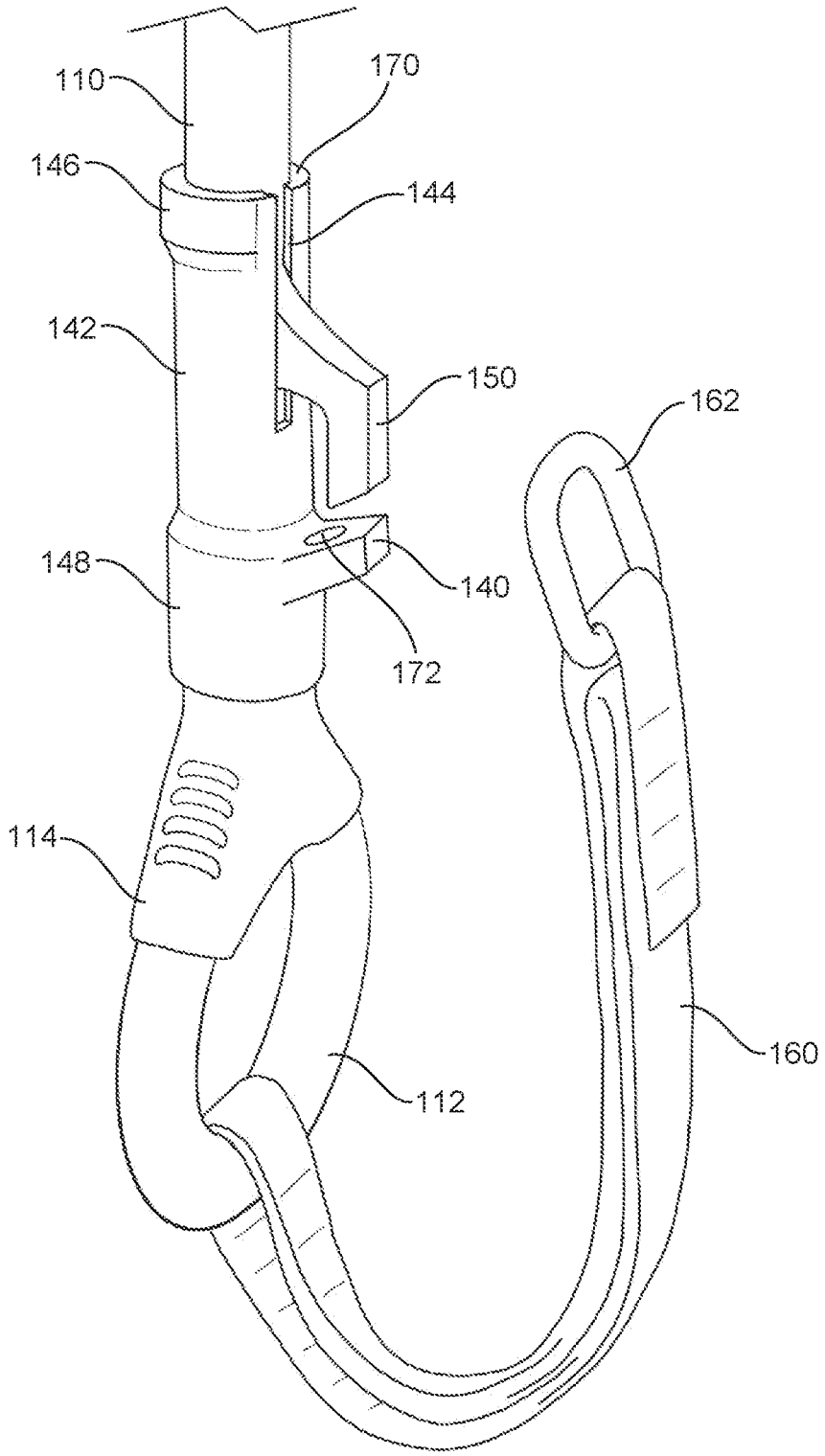
FIG. 5 shows a perspective view of a lower portion of an example climbing cam in accordance with the present disclosure.

FIG. 5 shows a perspective view of a lower portion of an example climbing cam. This close-up view shows the bottom end of the stem 110, which has a clip point 112 formed as a loop at the bottom of the stem. One end of the sling 160 is attached to the clip point. A grip cover 114 is positioned over a portion of the loop and the stem. The moveable latch 140 on a sliding sleeve 142 is shown in an open position in this figure. When the latch is open in this way, the trigger will typically be pulled down so that the trigger contacts and pushes on the sleeve. However, the trigger is not shown in this figure for the sake of visibility of the sleeve. In the open position, the moveable latch is separated from the fixed hook 150. In this example the fixed hook extends outward from the stem and then extends downward toward the moveable latch. The sliding sleeve includes a hook slot 144. The hook fits through the hook slot so that the sliding sleeve can slide up and down along the stem while the hook remains stationary. Although the sleeve can be designed with a variety of different shapes, in this example the sleeve has a flared upper portion 146 and a flared lower portion 148 with a narrower middle portion. The sleeve includes an upper surface 170. In this example, the trigger can push on this upper surface when the trigger is actuated. The flared upper portion can provide a larger upper surface area. The upper surface of the sleeve can have a width or diameter that is larger than the diameter of the through-hole of the trigger, by which the trigger slides along the stem. The flared lower portion of the sleeve can accommodate a spring (not shown) inside the sleeve. The spring can bias the sleeve upward. For example, the spring can apply an upward force on the sleeve relative to the stem. This force can bias the moveable latch against the fixed hook.

The example shown in FIG. 5 also includes a small magnet 172 located at the moveable latch. The magnet is on the upper face of the latch. The connection ring 162 on the sling 160 can be made of a magnetic material such as steel, which can be attracted to the magnet. In this figure, the connection ring is shown detached from the latch. However, when the connection ring is within the aperture of the latch, the magnet can contact the connection ring and help to hold the connection ring in place. In some cases, after opening the latch the magnet can continue to hold the connection ring in place. However, a gentle tug by a climber can pull the connection ring away from the magnet and the sling can be untethered from the latch.

As shown in the examples, the climbing cam can comprise a sling. The sling can have a first end and a second end where the first end of the sling can releasably attach to the stem of the climbing cam at the moveable latch. The second end of the sling can attach to the stem at a clip point on the stem. In one example, the sling can have three sewn loops: the hard end attached to the cam, the loop at the other end for the connector ring, and a large interior loop between the two end loops to which a carabiner can be clipped while staying out of the way when racked on the climbing harness. The sling can be operable to loop around a portion of the climbing harness to tether the stem to the climbing harness. The sling can comprise a connection ring that is disposed at the first end of the sling. The connection ring can facilitate the attachment of the first end of the sling to the moveable latch of the climbing cam. As mentioned above, in some examples the connection ring can be made from a magnetic material. As used herein, "magnetic material" refers to materials that are attracted to permanent magnets, such as iron or steel. A permanent magnet can be located at the moveable latch to attract the connection ring. The permanent magnet can be any type of magnet, such as a rare earth magnet, a ceramic magnet, a ferrite magnet, or other type of permanent magnet. In alternative examples, the moveable latch may not include a magnet.

In some examples, the moveable latch can form an aperture with a fixed hook that is formed stationary relative to the stem. The fixed hook can be an integral part of the stem itself in certain examples. In other examples, the fixed hook can be attached to the stem by any suitable method of attachment, such as gluing with an adhesive, welding, fastening with a fastener such as a screw, or other methods. In certain examples, the fixed hook can be a part of a sleeve that is designed to fit on the stem, but not to slide along the stem. For example, the sleeve can be attached to the stem in a way that prevents the sleeve from moving relative to the stem. In this way, the fixed hook can be stationary relative to the stem. In contrast, the moveable latch can be moveable relative to the stem. In some examples, the moveable latch can be disposed on a sleeve surrounding the stem. This sleeve can be slidable relative to the stem. For example, the stem can comprise a generally cylindrical shape, and the sleeve can comprise a generally cylindrical through-hole to slide along the stem. Alternatively, the stem can have an ovular or rectangular shape and the sleeve can have a through-hole of the same shape. This can allow the sleeve to slide along the stem but the sleeve is prevented from rotating around the stem. The through-hole of the sleeve can have a slidable interface with the stem such that the sleeve can slide along the stem. In this example, the sleeve can be biased such that the moveable latch on the sleeve can biased against the fixed hook.

Figure 6:
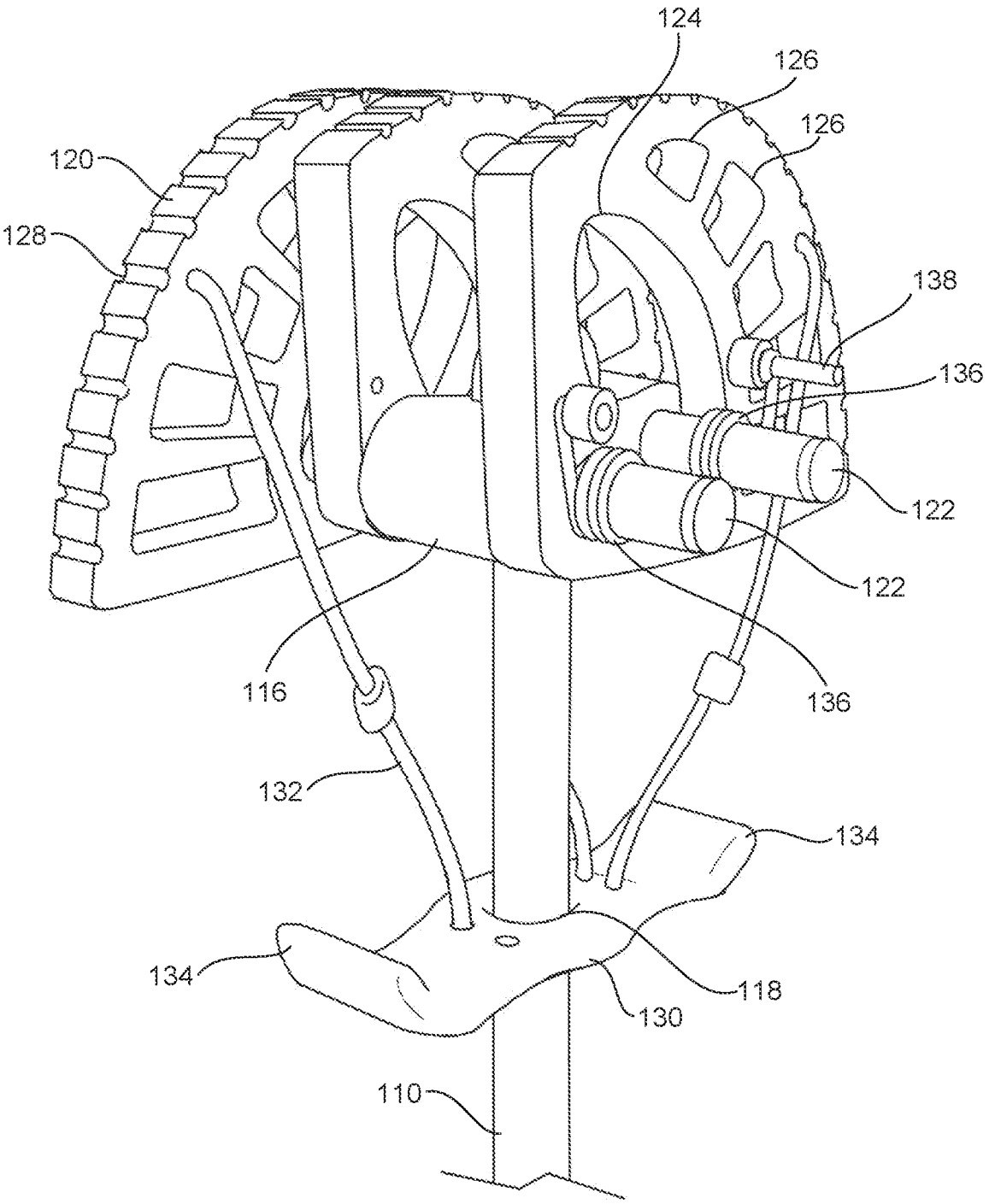
FIG. 6 shows a perspective view of an upper portion of an example climbing cam in accordance with the present disclosure.

FIG. 6 shows a perspective view of an upper portion of an example climbing cam. This example has four cam lobes 120 as in the previous examples, but one of the lobes is not shown so that other components can be more easily visible. The cam lobes are positioned at an upper end of the stem 110. The stem includes a spacer 116 that spaces apart the cam lobes. Two lobe axles 122 extend through the spacer. One lobe axle is offset forward relative to the stem, and the other lobe axle is offset backward relative to the stem. Two of the lobes rotate around each of the lobe axles. In particular, the two lobes that extend backward rotate around the lobe axle that is offset forward from the stem. The two lobes that extend forward (including the one lobe that is not shown in the figure) rotate around the lobe axle that is offset backward from the stem. Each of the lobes includes a rounded cutout 124 through which the opposite lobe axle extends so that the opposite lobe axle does not interfere with the rotation of each lobe. The lobes also include other cutouts 126, which are intended to save weight and material. In some examples, the lobes can be made without these additional cutouts. The cam lobes in this example also include grooves 128 on the surface of the cam lobes that contacts rock when the cam is placed in a rock crack. The grooves can provide better grip between the cam lobes and rock. Torsion springs 136 are coiled around the lobe axles. The torsion springs are attached to roll pins 138 that link the torsion springs to the cam lobes. Thus, the torsion springs provide a rotational force that tends to rotate the cam lobes so that the cam lobes extend outward. The climbing cam can include four separate torsion springs, one for each cam lobe.

Alternatively, the torsion springs can be formed as double springs, with two coils formed from a single piece of wire. The coils can be placed around two cam axles and two ends of the wire can attach to two roll pins.

FIG. 6 also shows cables 132 connecting the cam lobes 120 to the trigger 130. Three of the cables are shown. This example can also include a fourth cable to link the trigger to the fourth cam lobe, but the fourth cam lobe and the forth cable are not shown in this figure to make other components more easily visible. The trigger includes two handles 134 that are shaped to accommodate fingers of a climber, so that the climber can pull the trigger downward using two or more fingers. The trigger also includes a through-hole 118. The stem 110 of the climbing cam extends through the through-hole so that the trigger can slide along the stem. It is noted that the trigger in this figure is oriented differently than the trigger in FIG. 3 and FIG. 4. In this figure, the trigger extends from front to back, whereas in FIG. 3 and FIG. 4 the trigger extends from side to side. In various embodiments, the trigger can be oriented in different ways. The overall design of the climbing cam can be made to be convenient for a climber to hold the cam and actuate the trigger with one hand. In some examples, the trigger can be oriented parallel to the cam lobes. In other examples, the trigger can be oriented perpendicular to the cam lobes. In still further examples, the trigger can be oriented at an angle with respect to the cam lobes.

In some examples, the trigger can be connected to the cam lobes via at least one cable. When the trigger is actuated, the cables are tensioned to move the cam lobes from the expanded position to the retracted position. The trigger can further comprise a through-hole that surrounds and interfaces with the stem. The through-hole of the trigger can allow the trigger to slide along the stem.

In certain examples, the trigger can comprise a first handle extending from a first side of the through-hole and a second handle extending from a second side of the through-hole opposite the first side. The handles can be operable for engagement with a hand or finger of the climber. Thus, the climber can grasp the climbing cam and actuate the handle to move the trigger to both retract the cam lobes (i.e. "load" the climbing cam) and to open the aperture of the moveable latch to untether the climbing cam from a climbing harness in one fluid hand movement.

In more detail regarding the trigger, a variety of designs can be used for the trigger. As explained above, the trigger can be operable to retract the cam lobes and to lope the moveable latch when the trigger is actuated. As long as the trigger is operable to perform these functions, a wide variety of designs may be used. In some examples, the trigger can include two handles contoured to fit the fingers of a climber, as shown in the figures above. However, in other examples the trigger may not be contoured in this way. In some cases, the trigger can be a flat plate or a flat disc. In further examples, the trigger can comprise a lever, a button, a piston, a switch, a knob, or other mechanism that can be actuated to retract the cam lobes and open the moveable latch.

In further detail regarding the cam lobes, the climbing cams described herein can include one or more cam lobes. The cam lobes can be operable to retract when the trigger is actuated and to expand when the trigger is released. In some examples, the climbing cam can comprise at least one lobe axle. The cam lobes can be mounted to lobe axle(s) and can be rotatable about the lobe axle(s). A torsion spring can be disposed on the lobe axle(s) and can be connected to the cam lobes. The torsion spring can bias the cam lobe into the expanded position. Thus, when the trigger is released by a user, the cam lobes can return from the retracted position to the expanded position. In some examples, the torsion spring can include a coil surrounding a lobe axle. In further examples, the torsion spring can be connected to a roll pin, and the roll pin can extend at least partially through a cam lobe. In alternative examples, other types of springs can be used to bias the cam lobes toward the expanded position. The springs can include coiled springs, flat springs, needle springs, or other types of springs.

The cam lobes can be retracted when the trigger is actuated, which allows the cam to be placed in a rock crack. When the trigger is released, the cam lobes can expand and contact the rock on the sides of the crack. In some examples, the shape of the cam lobes can cause the cam lobes to expand further when weight is applied to the cam. Thus, the cam lobes can grip the rock more strongly when weight is applied to the cam. In certain examples, the cam lobes can have the shape of a logarithmic spiral. With this shape, the overall width of the cam can increase when the cam lobes rotate toward the expanded position.

Figure 7:
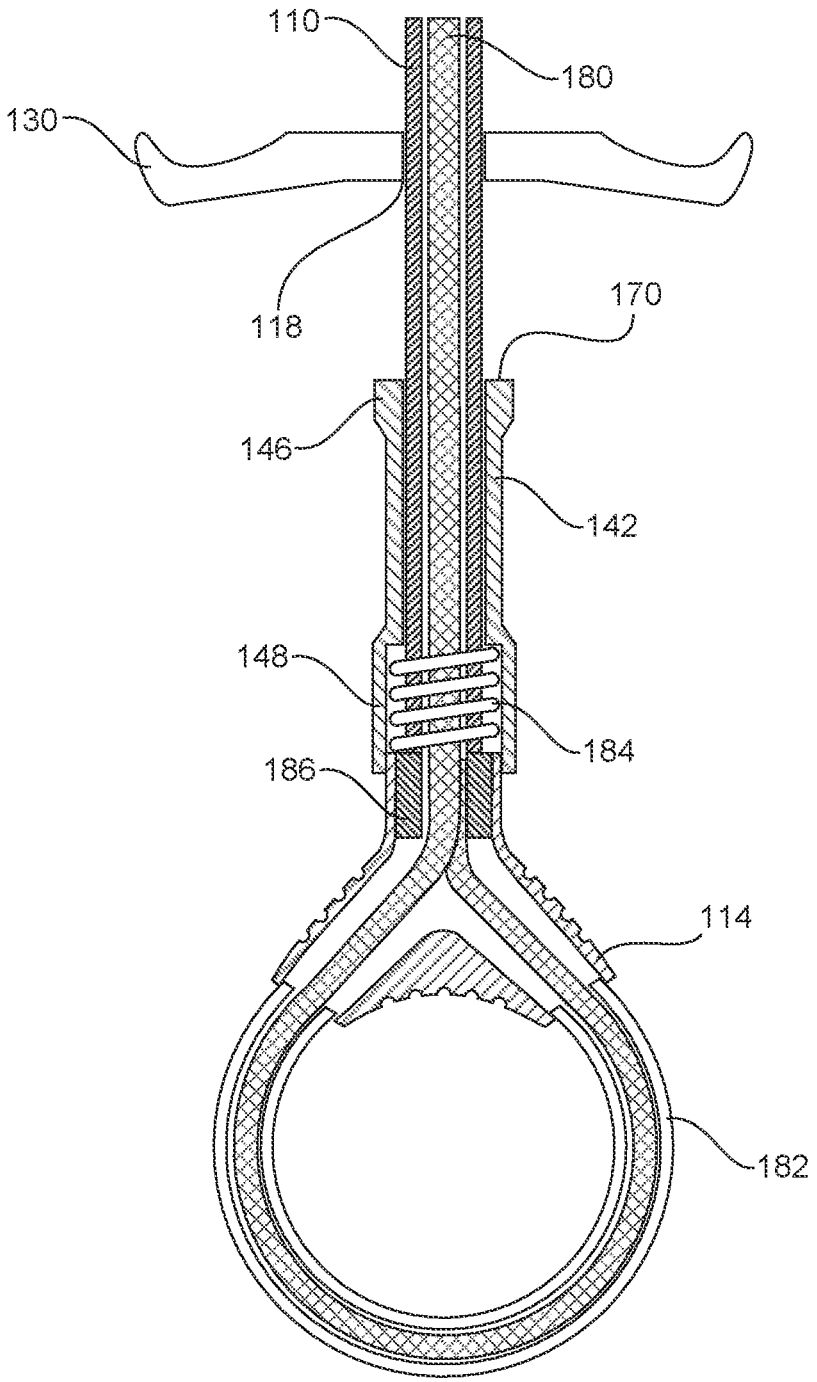
FIG. 7 shows a cross-sectional view of an example climbing cam in accordance with the present disclosure.

FIG. 7 is a cross-sectional view of a lower portion of an example climbing cam. The cross-sectional view corresponds to a cross-section of the front view in FIG. 3. The upper portion of the cam, including the cam lobes, is omitted so that the internal components of the lower portion can be shown in more detail. The stem 110 in this example is a hollow cylindrical tube. The fixed hook (not shown) can be formed as an integral part of this tube. The trigger 130 includes a through-hole 118 that can slide along the stem. A sliding sleeve 142 can also slide along the stem. The moveable latch (not shown) can be formed as a part of this sliding sleeve. Inside the hollow stem, a structural cable 180 extends through the stem and forms a loop at the bottom end of the stem. This structural cable can be made of a material with high tensile strength, such as a braided steel cable. The structural cable can provide sufficient strength to hold the weight of a climber and the shock force applied to the cam when a climber falls. In some examples, the cable loop at the bottom of the cam can be bare cable. However, in this example, a loop cover 182 is placed over the cable loop. This loop cover can be a piece of flexible tubing or a more rigid ring of a material such as metal, plastic, rubber, or another material. The loop is also referred to above as a clip point. A grip cover 114 is placed over the bottom of the stem and a portion of the loop. The grip cover can be sized and shaped so that a thumb of a climber can be used to push upward on the stem while the fingers of the climber are used to pull downward on the trigger. A spring 184 is placed inside the sliding sleeve. The spring surrounds the stem, occupying a space between the stem and the sliding sleeve. The spring can be a linear spring, although non-linear springs can be used. In this example, the sliding sleeve has a flared lower portion 148 that has a hollow space inside to accommodate the spring. The sleeve also has a narrower middle section, and the inside of the sleeve is formed so that the narrower middle section pressed downward on the spring to compress the spring when the sleeve slides downward. A spring seat 186 is placed inside the grip cover at the bottom of the stem. The spring seat remains stationary relative to the stem, so that the spring is compressed between the sliding sleeve and the spring seat when the sliding sleeve moves downward. The sliding sleeve also has a flared upper portion 146 with an upper surface 170. As explained above, the trigger can be pulled downward until the trigger contacts the upper surface of the sliding sleeve. The trigger then pushes the sliding sleeve downward to compress the spring inside the sliding sleeve. When the trigger is released, the spring expands and pushes the sliding sleeve back up to its original position.

In further examples, the design and mechanism of the moveable latch can vary. In some examples, the moveable latch can be on a sliding sleeve and the sliding sleeve can be biased by a spring, as in the example shown above. In other examples, the moveable latch can be designed without a sliding sleeve. In some examples, a spring can be located inside the sliding sleeve as in the example shown above. However, other examples can include a spring that is outside the sleeve, or a sleeve with an integrated spring, or a stem with an integrated spring that biases the sliding sleeve, or a stem with an integrated spring that biases a moveable latch without a sliding sleeve. Accordingly, the climbing cams are not limited to specific mechanism shown in the above figures.

The present disclosure also describes attachment systems for climbing cams. The attachment systems can include some of the same components included in the climbing cams described above. The systems can refer to a group of components, whether the components are assembled as parts of a complete climbing cam, or whether the components are gathered, packaged, or sold as kit or upgrade for a separate climbing cam. In one example, an attachment system for a climbing cam can include a hook that is fixable to a stem of a climbing cam. The hook can be stationary relative to the stem. The system can also include a sleeve sized and shaped to surround the stem and slide relative to the stem. The sleeve can include a latch positioned to contact to contact the hook when the latch is in a closed position. A spring can be positioned to bias the sleeve so that the latch is biased against the hook to form an aperture. In some examples, the spring can be positioned inside the sleeve and the spring can surround the stem of the climbing cam. These components can be positioned so that, when the latch is in the closed position, the sleeve is positioned to engage with a trigger of the climbing cam when the trigger is pulled by a climber to move the latch away from the hook and open the aperture.

In further examples, the system can also include a sling. A first end of the sling can be releasably attachable to the latch and the second end can be attachable to the stem of the climbing cam. The sling can include a connection ring disposed at the first end. The sling can attach to the latch by placing the connection ring in the aperture of the latch and closing the latch. The sling can then be released by opening the latch as described above.

In summary, the features described above can provide a climbing cam that can be simultaneously untethered from a harness and loaded in one fluid motion. In this manner, the climber does not need to change her/his grip on the climbing cam while removing it from her/his harness and loading the climbing cam to place it in a crack of a rock.

The foregoing detailed description describes the subject technology with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A climbing cam comprising:

a stem;

a moveable latch disposed on the stem and operable to tether the stem to a climbing harness of a climber;

a spring-loaded cam lobe disposed on a first end of the stem; and a trigger connected to the cam lobe, the trigger being actuatable to retract the cam lobe from an expanded position to a retracted position and to open the moveable latch allowing the stem to untether from the climbing harness when the cam lobe is in the retracted position.

2. The climbing cam of claim 1, further comprising a sling having a first end and a second end, the first end of the sling releasably attaching to the stem at the moveable latch and the second end of the sling attaching to the stem, the sling being operable to loop around a portion of the climbing harness to tether the stem to the climbing harness.

3. The climbing cam of claim 2, wherein the stem comprises a clip point disposed on a second end of the stem opposite the spring-loaded cam lobe, and wherein the second end of the sling attaches to the clip point.

4. The climbing cam of claim 3, further comprises a structural cable extending through the clip point and the stem.

5. The climbing cam of claim 2, wherein the sling comprises a connection ring disposed at the first end of the sling, the connection ring releasably attaching to the stem at the moveable latch.

6. The climbing cam of claim 5, wherein the connection ring comprises a magnetic material and wherein the moveable latch comprises a magnet positioned to contact the connection ring when the connection ring is attached to the stem at the moveable latch.

7. The climbing cam of claim 1, further comprising a fixed hook that is formed stationary relative to the stem wherein the moveable latch is moveable relative to the stem and wherein the moveable latch contacts the fixed hook when the moveable latch is in a closed position.

8. The climbing cam of claim 7, wherein the moveable latch is disposed on a sleeve surrounding the stem, the sleeve being slidable relative to the stem, and the sleeve being biased such that the moveable latch is biased against the fixed hook to form an aperture.

9. The climbing cam of claim 8, wherein the trigger engages with the sleeve to slide the sleeve relative to the stem to move the moveable latch away from the fixed hook to open the aperture.

10. The climbing cam of claim 8, wherein the sleeve comprises a linear spring surrounding the stem that biases the sleeve such that the moveable latch is biased against the fixed hook.

11. The climbing cam of claim 1, wherein the trigger is connected to the cam lobe via at least one cable.

12. The climbing cam of claim 1, wherein the trigger comprises a through-hole that surrounds the stem, and the trigger slides along the stem.

13. The climbing cam of claim 12, wherein the trigger comprises a first handle extending from a first side of the through-hole and a second handle extending from a second side of the through-hole opposite the first side, the first and second handles being operable for engagement with a hand or finger of the climber.

14. The climbing cam of claim 1, further comprising a lobe axle, the cam lobe being mounted to the lobe axle and rotatable about the lobe axle.

15. The climbing cam of claim 14, further comprising a torsion spring disposed on the lobe axle and connected to the cam lobe, the torsion spring biasing the cam lobe into the expanded position.

16. A climbing cam comprising:

a stem comprising a first end and a second end, the first end comprising a clip point;

an attachment aperture disposed on the stem between the first end and the second end of the stem, the attachment aperture comprising a fixed hook that is formed stationary relative to the stem and a moveable latch that is moveable relative to the stem, the moveable latch operable to move adjacent to and in contact with the fixed hook to close the attachment aperture and to move away from the fixed hook to open the attachment aperture, and the moveable latch being biased into contact with the fixed hook;

a sling comprising a first connection point that attaches to the clip point at the first end of the stem and comprising a second connection point that attaches to the attachment aperture, the sling being operable to tether the stem to a climbing harness of a climber;

a plurality of spring-loaded cam lobes disposed on the second end of the stem, the plurality of cam lobes being movable from an expanded position to a retracted position, and the plurality of cam lobes being biased toward the expanded position; and a trigger connected to the cam lobes by at least one trigger cable, the trigger being actuatable to retract the cam lobes from the expanded position to the retracted position via the trigger cable, and the trigger being operable to actuate the moveable latch to move away from the fixed hook to open the attachment aperture allowing the stem to untether from the climbing harness while the cam lobes are in the retracted position.

17. An attachment system for a climbing cam, comprising:

a hook for attachment to a stem of the climbing cam such that the hook is stationary relative to the stem;

a sleeve sized and shaped to surround the stem and slide relative to the stem, wherein the sleeve comprises a latch positioned to contact the hook when the latch is in a closed position;

a spring positioned to bias the sleeve such that the latch is biased against the hook to form an aperture; and a sling having a first end and a second end, the first end being releasably attachable to the latch and the second end being attachable to the stem, wherein when the latch is in the closed position, the sleeve is positioned to engage with a trigger of the climbing cam when the trigger is pulled by a user to move the latch away from the hook to open the aperture.

18. The system of claim 17, wherein the spring is positioned inside the sleeve and surrounding the stem.

19. The system of claim 17, wherein the sling comprises a connection ring disposed at the first end of the sling, wherein the sling is releasably attachable to the latch by the connection ring.

* * * * *